US009715202B2

(12) United States Patent
Maeda

(10) Patent No.: US 9,715,202 B2
(45) Date of Patent: Jul. 25, 2017

(54) FIXING MEMBER, FIXING APPARATUS, IMAGE FORMING APPARATUS, AND METHOD OF PRODUCING FIXING MEMBER

(71) Applicant: CANON KABUSHIKI KAISHA, Tokyo (JP)

(72) Inventor: Matsutaka Maeda, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/260,680

(22) Filed: Sep. 9, 2016

(65) Prior Publication Data

US 2017/0097597 A1 Apr. 6, 2017

(30) Foreign Application Priority Data

Oct. 6, 2015 (JP) ..... 2015-198868

(51) Int. Cl.
*G03G 15/20* (2006.01)

(52) U.S. Cl.
CPC . *G03G 15/2057* (2013.01); *G03G 2215/2048* (2013.01)

(58) Field of Classification Search
CPC ..... G03G 15/2057; G03G 2215/2048
USPC ..... 399/333
See application file for complete search history.

(56) References Cited

U.S. PATENT DOCUMENTS 9,465,338 B2 10/2016 Maeda et al.
2005/0201784 A1 9/2005 Suzuki
2007/0292660 A1* 12/2007 Kikukawa ..... G03G 15/2057 428/152

(Continued)

FOREIGN PATENT DOCUMENTS

JP 10-142990 A 5/1998
JP 2002-023539 A 1/2002

(Continued)

OTHER PUBLICATIONS

Gabriele Kaiser et al., "Medizintechnik—Analysen an Dünnen PTFE-Schichten Mittels DSC," retrieved from http://www.devicemed.de/medizintechnik-analysen-an-duennen-ptfe-schichten-mittels-dsc-a-450859, pp. 1-3 (Apr. 30, 2016) (XP055338556).

(Continued)

*Primary Examiner* — Sophia S Chen
(74) *Attorney, Agent, or Firm* — Fitzpatrick, Cella, Harper & Scinto

(57) ABSTRACT

A fixing member including a surface layer having high resistance to wear is provided. The fixing member includes a surface layer containing polytetrafluoroethylene (PTFE) and a fluorine resin having a melting point lower than that of the PTFE. In the DSC (endothermic) curve obtained by heating a sample of the surface layer at a temperature raising rate of 20° C./min with a differential scanning calorimeter (DSC), an endothermic peak 1 having a peak top in the temperature range of 330° C. or more and 340° C. or less, and an endothermic peak 2 having a peak top in the temperature range lower than that of the endothermic peak 1 are present, and the sum ΔH of the amount of heat of fusion based on the endothermic peak 1 and the amount of heat of fusion based on the endothermic peak 2 is 40 J/g or more and 55 J/g or less.

13 Claims, 4 Drawing Sheets

(56) References Cited

U.S. PATENT DOCUMENTS

| | | | | |
|---|---|---|---|---|
| 2012/0141176 | A1* | 6/2012 | Matsushima ..... | G03G 15/6585 399/341 |
| 2012/0309602 | A1 | 12/2012 | Nakajima et al. | |
| 2014/0107250 | A1* | 4/2014 | Maeda ..... | G03G 15/2057 399/333 |
| 2014/0133892 | A1* | 5/2014 | Miura ..... | G03G 15/2057 399/333 |
| 2015/0277303 | A1 | 10/2015 | Oshima et al. | |

FOREIGN PATENT DOCUMENTS

| | | | |
|---|---|---|---|
| JP | 2004-319216 | A | 11/2004 |
| JP | 2009-015137 | A | 1/2009 |
| JP | 2011-175218 | A | 9/2011 |

OTHER PUBLICATIONS

Sandeep Kumar Patro et al., "Drug-Excipient Cornpatability Studies Using Thermal Methods," retrieved from http://www.pharmachitchat.com/drug-excipient-compatability-studies-using-thermal-methods/, pp. 1-19 (retrieved Jan. 25, 2017) (XP055338538).

C. J. Mason et al., "The Minimisation of aqua regia Cross Contamination in PFA and TFM Microwave Digestion Vessels Using Silver as an Indicator," 125(2) Analyst 327-332 (Jan. 2000) (XP055338307).

Partial European Search Report in European Application No. 16189837.4 (Feb. 8, 2017).

Extended European Search Report in European Application No. 16189837.4 (dated Jun. 2, 2017).

* cited by examiner

FIXING MEMBER, FIXING APPARATUS, IMAGE FORMING APPARATUS, AND METHOD OF PRODUCING FIXING MEMBER

BACKGROUND OF THE INVENTION

Field of the Invention

The present invention relates to fixing members included in fixing apparatuses for electrophotographic image forming apparatuses, and image forming apparatuses.

Description of the Related Art

Electrophotographic image forming apparatuses (hereinafter, simply referred to as "image forming apparatuses") such as printers, copiers and fax machines include fixing apparatuses provided with fixing members in the form of a film or a roller. It is known that some of these fixing members have a configuration including a substrate made of a heat-resistant resin or a metal in the form of a film or a roller, an elastic layer containing a heat-resistant rubber formed on the substrate, and a surface layer containing a fluorine resin (hereinafter, referred to as "fluorine resin layer" in some cases) having high releasing properties from toners and formed on the elastic layer.

Japanese Patent Application Laid-Open Nos. H10-142990, 2009-15137 and 2011-175218 disclose fixing members including surface layers disposed thereon, the surface layers being fluorine resin layers formed through firing of a coating of a dispersion solution of polytetrafluoroethylene (PTFE) and a different fluorine resin having higher releasing properties than that of the PTFE, such as a tetrafluoroethylene-perfluoroalkyl vinyl ether copolymer (PFA) and a tetrafluoroethylene-hexafluoropropylene copolymer (FEP).

One aspect of the present invention is directed to providing a fixing member having high resistance to wear and a method of producing the fixing member. Another aspect of the present invention is directed to providing a fixing apparatus and an image forming apparatus which can stably provide high-quality images.

SUMMARY OF THE INVENTION

According to one aspect of the present invention, there is provided a fixing member comprising a surface layer containing polytetrafluoroethylene (PTFE) and a fluorine resin having a melting point lower than that of the PTFE, wherein in a DSC (endothermic) curve obtained by heating a sample of the surface layer at a temperature raising rate of 20° C./min with a differential scanning calorimeter (DSC), an endothermic peak 1 having a peak top in the temperature range of 330° C. or more and 340° C. or less, and an endothermic peak 2 having a peak top in the temperature range lower than that of the endothermic peak 1 are present, and a sum ΔH of an amount of heat of fusion based on the endothermic peak 1 and an amount of heat of fusion based on the endothermic peak 2 is 40 J/g or more and 55 J/g or less.

According to another aspect of the present invention, there is provided a fixing apparatus comprising a fixing member, and a pressurizing member disposed facing the fixing member, wherein the fixing member is the fixing member described above.

According to further aspect of the present invention, there is provided an image forming apparatus comprising a fixing unit for fixing a non-fixed toner image on a recording material, wherein the fixing unit includes the fixing apparatus described above.

According to further aspect of the present invention, there is provided a method of producing a fixing member comprising an elastic layer, and a surface layer containing polytetrafluoroethylene (PTFE) and a fluorine resin having a melting point lower than that of the PTFE, the method including forming a coating of a coating material for forming a surface layer on an elastic layer, the coating material for forming a surface layer containing PTFE having a melting point of 330° C. or more and 340° C. or less and a fluorine resin having a melting point lower than that of the PTFE at a mixing ratio of 40:60 to 60:40 (mass ratio); and heating the coating at a temperature of 315° C. or more and less than the melting point of the PTFE to form the surface layer.

Further features of the present invention will become apparent from the following description of exemplary embodiments with reference to the attached drawings.

DESCRIPTION OF THE EMBODIMENTS

Figure 1:
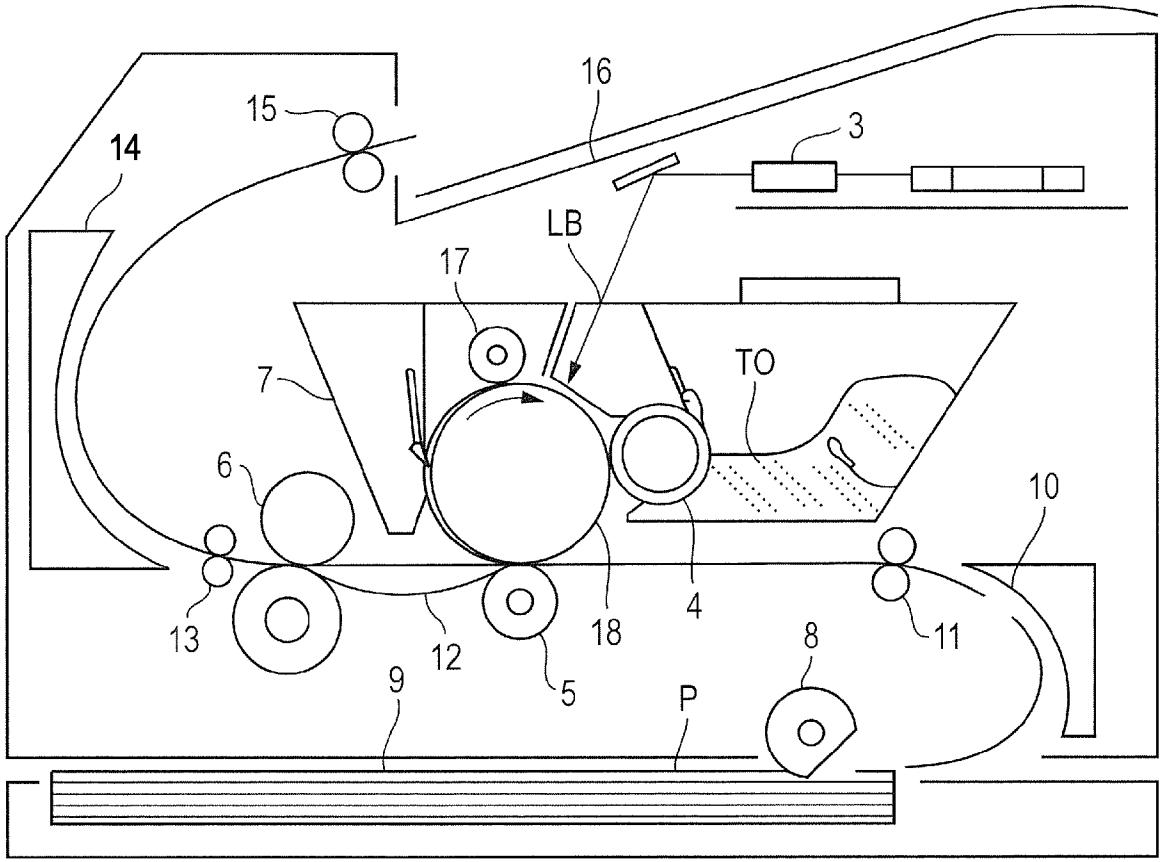
FIG. 1 is a schematic configurational view of one example of the image forming apparatus according to one aspect of the present invention.

Preferred embodiments of the present invention will now be described in detail in accordance with the accompanying drawings.

A further improvement in durability of the surface layer containing a fluorine resin has been required with an increase in printing speed of image forming apparatuses.

It is considered that an increase in proportion of the PTFE contained in the mixed fluorine resin of PTFE and a different fluorine resin described above is effective in an improvement in the durability (resistance to wear) of the surface layer. However, in the case that the proportion of PTFE contained in the surface layer containing PTFE and a different fluorine resin is simply increased, the proportion of the different fluorine resin contained in the fluorine resin is relatively reduced, which may cause difficulties in maintaining functions derived from the different fluorine resin, such as the releasing properties of the surface of the surface layer.

For this reason, the present inventors have recognized that there is a need for development of techniques for improving the resistance to wear of the surface layer instead of the method of increasing the proportion of PTFE contained in the surface layer containing PTFE and a different fluorine resin.

The present inventors have conducted further research to improve resistance to wear of the surface layer containing a fluorine resin. As a result, the present inventors have found that the degree of crystallization of the fluorine resin contained in the surface layer is closely related with the resistance to wear of the surface layer. Specifically, the present inventors have found that an increase in the degree of crystallization of the fluorine resin in the surface layer can further improve the resistance to wear of the surface of the surface layer.

In the present invention, the degree of crystallization of a fluorine resin is represented by the amount of heat of fusion ΔH (J/g) calculated based on the endothermic peak by heating a sample at a temperature raising rate of 20° C./min with a differential scanning calorimeter (DSC).

Here, the present inventors have paid attention to a fluorine resin or fluoropolymer "as polymerized." The fluorine resin is synthesized through polymerization of a monomer containing fluorine atoms. A fluorine resin maintaining the state immediately after polymerization is called "fluorine resin as polymerized."

In other words, the fluorine resin as polymerized has a high degree of crystallization because of its molecular chains densely arranged. If the fluorine resin as polymerized is fused, this dense arrangement of the molecular chains of the fluorine resin collapses, losing the highly crystalline state unique to the fluorine resin as polymerized.

For this reason, the present inventors have paid attention to the fact that the melting point of the PTFE is higher than that of a different fluorine resin other than the PTFE, such as PFA or FEP, in formation of a surface layer containing a fused product of a mixture of the PTFE as polymerized and the different fluorine resin, and have examined a method for maintaining the properties of the PTFE as polymerized in the surface layer by heating the mixture at a temperature range not fusing the PTFE while fusing the different fluorine resin. Namely, the present inventors considered that the resistance to wear of the surface layer can be further improved by maintaining a high degree of crystallization unique to the PTFE as polymerized in the PTFE contained in the surface layer.

The melting point of the PTFE losing the properties of the PTFE as polymerized is 325° C. The melting point of the PTFE as polymerized is 330° C. or more. Accordingly, a surface layer containing a fluorine resin was formed through firing of a coating of a dispersion solution of the PTFE as polymerized and a different fluorine resin at a temperature of less than the melting point of the PTFE as polymerized. It was found that the PTFE in the resulting surface layer had a melting point of 330° C. or more, and maintained the state of the PTFE as polymerized. It was also found that the fluorine resin in the surface layer had ΔH of 40 J/g or more, and had a high degree of crystallization.

Namely, the present inventors have found that in formation of a surface layer through firing of a coating of a dispersion solution containing PTFE and a different fluorine resin, a surface layer having high resistance to wear is obtained by using PTFE "as polymerized" and forming the surface layer so as to maintain the state of the PTFE "as polymerized" in the surface layer.

Thereby, a surface layer having high resistance to wear can be obtained without reducing the proportion of the different fluorine resin other than the PTFE contained in the surface layer containing the PTFE and the different fluorine resin.

The fixing member according to one aspect of the present invention and a method of producing the fixing member will now be specifically described.

(Configuration of Fixing Member)

Figure 3:
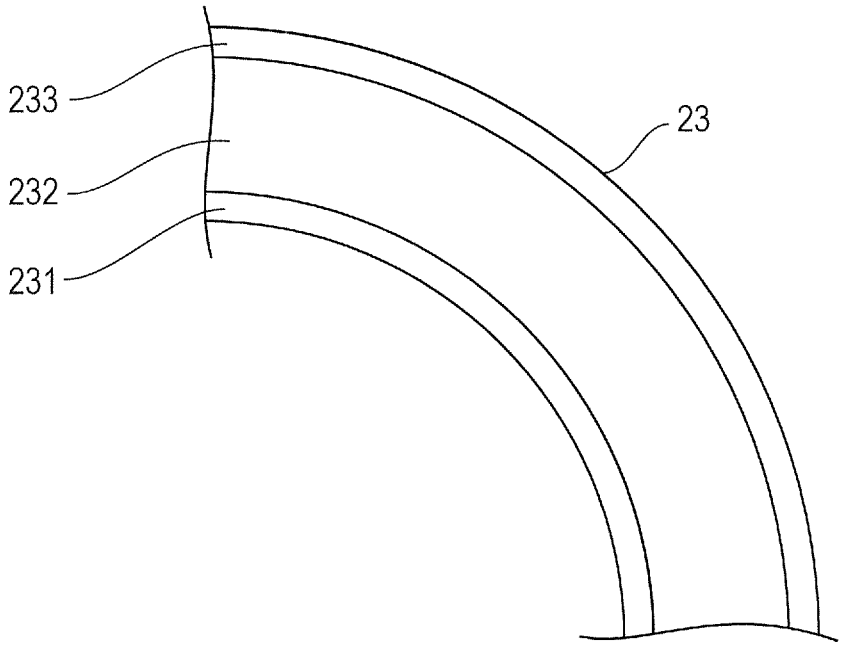
FIG. 3 is a schematic configurational view of a cross section of one example of the fixing member according to one aspect of the present invention.

FIG. 3 is a partial cross-sectional view of a fixing member (hereinafter, also referred to as "fixing belt") 23 according to one aspect of the present invention in the form of an endless belt. In FIG. 3, the fixing belt 23 includes a substrate 231 in the form of an endless belt, an elastic layer 232, and a surface layer 233 disposed on the outer peripheral surface of the substrate 231 in this order.

The fixing member may have a layer configuration including the substrate 231 and the surface layer 233 formed thereon without the elastic layer 232, or may have a multilayer configuration including a plurality of elastic layers 232. The form of the fixing member is not limited to the form of a belt. The fixing member may be in the form of a roller.

<Surface Layer>

In the surface layer 233, an endothermic peak 1 having a peak top in the temperature range of 330° C. or more and 340° C. or less, and an endothermic peak 2 having a peak top in the temperature range lower than that of the endothermic peak 1 are present in a DSC (endothermic) curve obtained by heating a sample of the surface layer at a temperature raising rate of 20° C./min with a differential scanning calorimeter (DSC), and the sum ΔH of an amount of heat of fusion based on the endothermic peak 1 and an amount of heat of fusion based on the endothermic peak 2 is 40 J/g or more and 55 J/g or less.

The endothermic peak 1 is derived from the PTFE contained in the surface layer, and the endothermic peak 2 is derived from the fluorine resin having a melting point lower than that of the PTFE. The PTFE as polymerized has a melting point of 330° C. or more and 340° C. or less. The PTFE as polymerized once fused loses the state of polymerization unique to the PTFE as polymerized, and thus has a melting point of less than 330° C.

The peak top of the endothermic peak represents a vertex of the fusion peak (melting point) in a DSC curve obtained through measurement of the sample with a differential scanning calorimeter by heating the sample at a temperature raising rate of 20° C./min. The DSC curve is obtained according to JIS K7121-1987. Specifically, a sample (about 5 mg) of the surface layer is precisely weighed, and is placed in an aluminum pan. An empty aluminum pan is used as a reference. The measurement is performed at a temperature ranging from 50° C. to 400° C.

In the DSC curve of the sample of the surface layer 233, the sum ΔH of the amount of heat of fusion based on the endothermic peak 1 and the amount of heat of fusion based on the endothermic peak 2 is 40 J/g or more and 55 J/g or less. At ΔH of 40 J/g or more, the surface layer has a high degree of crystallization, and hence high resistance to wear. To attain a surface layer having a high degree of crystallization and ΔH of more than 55 J/g, the content of the PTFE should be increased even if the PTFE as polymerized is contained. As a result, the content of a different fluorine resin other than the PTFE in the fluorine resin contained in the surface layer should be relatively decreased. Accordingly, the sum ΔH is preferably controlled within the range specified above to provide high releasing properties required for the fixing member while high resistance to wear is maintained. The sum ΔH is more preferably 43 J/g or more and 55 J/g or less.

In the DSC curve obtained above, the sum ΔH represents an area surrounded by the DSC curve containing the endothermic peak 1 and the endothermic peak 2 and a baseline.

PTFE as polymerized is used as the PTFE to control the sum ΔH within this range. The PTFE as polymerized indicates PTFE having no history of fusion after polymerization. The PTFE as polymerized is commercially available as "KTL-500F" (trade name, manufactured by KITAMURA LIMITED), for example.

Specific examples of fluorine resins having a melting point lower than that of the PTFE (hereinafter, also referred to as "different fluorine resins") include tetrafluoroethylene-perfluoroalkyl vinyl ether copolymers (PFA) and tetrafluoroethylene-hexafluoropropylene copolymers (FEP). Among these fluorine resins, particularly PFA is suitably used to give high toner releasing properties to the outer surface of the surface layer.

The different fluorine resin can have a relatively high degree of crystallization. Specifically, when PFA is used as the different fluorine resin, PFA having a melting point or a temperature of the endothermic peak 2 in the DSC of 300° C. or more and 315° C. or less can be used. The PFA preferably has an amount of heat of fusion of 20 J/g or more, particularly 20 J/g or more and 30 J/g or less. Examples of commercial products of such PFA include "Teflon (registered trademark) PFA 350-J" (manufactured by Du Pont-Mitsui Fluorochemicals Company, Ltd.).

The amounts of the PTFE and the different fluorine resin contained may affect the value of ΔH of the surface layer. In other words, the single substance PTFE has ΔH higher than that of the different fluorine resin, and a simple increase in the content of the PTFE in the fluorine resin can increase the sum ΔH. However, an increase in content of the PTFE relatively decreases the content of the different fluorine resin, which may lead to difficulties in sufficiently ensuring the functions brought by the different fluorine resin, such as releasing properties.

Accordingly, the mixing ratio of the PTFE to the different fluorine resin in the fluorine resin (PTFE:different fluorine resin) is preferably 40:60 to 60:40 (mass ratio). In use of PTFE having a melting point of 330° C. or more and 340° C. or less, the sum ΔH can be appropriately controlled within the range of 40 J/g or more and 55 J/g or less at a mixing ratio in the range specified above. The mixing ratio is particularly preferably 40:60 to 50:50 (mass ratio).

The surface layer 233 can have a thickness of 10 μm or more and 25 μm or less from the viewpoint of the resistance to wear and heat conductivity.

The surface layer 233 may contain a filler such as carbon, carbides, metals and metal oxides.

<Substrate>

The substrate 231 can be formed with a resin material such as polyimide (PI), polyamideimide (PAI), polyether ether ketone (PEEK) or polyethersulfone (PES), or a metal material such as stainless steel or nickel. The substrate preferably has a thickness of 20 μm or more and 100 μm or less, particularly 20 μm or more and 60 μm or less to reduce the heat capacity and improve quick starting properties of a fixing apparatus 6.

<Elastic Layer>

The elastic layer 232 can be formed with a known elastic material. Specifically, a silicone rubber or a fluorocarbon rubber is used. Among these rubbers, a silicone rubber is preferred.

A raw material for a silicone rubber can be a polymer having fluidity at room temperature, and a liquid silicone rubber cured by heating can be used. An elastic layer 232 formed with such a liquid silicone rubber has appropriately low hardness, and has sufficient heat resistance and resilience used in the fixing apparatus 6. In particular, an addition-crosslinked liquid silicone rubber can be used because of its high processability, and high stability of dimensional accuracy, and high productivity due to generation of no reaction by-product during the curing reaction.

The addition-crosslinked liquid silicone rubber composition contains the following basic configurational components (a), (b) and (c):

(a) an organopolysiloxane having an unsaturated aliphatic group;

(b) an organopolysiloxane having active hydrogen bonded to silicon; and (c) a hydrosilylating catalyst.

Examples of the organopolysiloxane having an unsaturated aliphatic group as the component (a) include:

linear organopolysiloxanes having both terminals of the molecule represented by $R1_2R2SiO_{1/2}$ and an intermediate unit represented by R12SiO and R1R2SiO, and branched polyorganosiloxanes having both terminals of the molecule represented by $R1_2R2SiO_{1/2}$ and containing $R1SiO_{3/2}$ and/or $SiO_{4/2}$ in the intermediate unit, where R1 represents an unsubstituted or substituted monovalent hydrocarbon group bonded to a silicon atom and having no aliphatic unsaturated group. Specific examples thereof include alkyl groups (such as a methyl group, an ethyl group, a n-propyl group, a n-butyl group, a n-pentyl group and a n-hexyl group), aryl groups (a phenyl group and a naphthyl group), and substituted hydrocarbon groups (such as a chloromethyl group, a 3-chloropropyl group, a 3,3,3-trifluoropropyl group, a 3-cyanopropyl group and a 3-methoxypropyl group).

In particular, 50% or more of R1 is preferably a methyl group, and more preferably all of R1 is a methyl group because synthesis and handling are easy, and high heat resistance is attained.

R2 represents an unsaturated aliphatic group bonded to a silicon atom. Examples of R2 include a vinyl group, an aryl group, a 3-butenyl group, a 4-pentenyl group and a 5-hexenyl group. In particular, a vinyl group can be used because synthesis and handling are easy, and the crosslinking reaction of silicone rubber is readily performed.

The organopolysiloxane as the component (a) can have a number average molecular weight of 5,000 or more and 100,000 or less and a mass weight average molecular weight of 10,000 or more and 500,000 or less.

The organopolysiloxane having active hydrogen bonded to silicon as the component (b) is a crosslinking agent for forming a crosslinked structure through reaction with the alkenyl group in the component (a) due to the catalytic action of a platinum compound.

In the component (b), the number of hydrogen atoms bonded to silicon atoms can be more than 3 in average in the molecule. Examples of an organic group bonded to a silicon atom include the same unsubstituted or substituted monovalent hydrocarbon groups as R1 of the organopolysiloxane component having an unsaturated aliphatic group. In particular, a methyl group can be used because synthesis and handling are easy. The organopolysiloxane having active hydrogen bonded to silicon can have any molecular weight.

The viscosity at 25° C. of the component (b) is in the range of preferably 10 $mm^2/s$ or more and 100,000 $mm^2/s$ or less, more preferably 15 $mm^2/s$ or more and 1,000 $mm^2/s$ or less. At a viscosity of 10 $mm^2/s$ or more, the organopolysiloxane is unlikely to volatilize during storage, and the resulting silicone rubber can have a desired degree of crosslinking and physical properties. At a viscosity of 100,000 $mm^2/s$ or less, the organopolysiloxane can be readily handled, and be homogeneously dispersed in a system.

The siloxane as the component (b) can be a siloxane having a linear, branched or cyclic skeleton, or a mixture thereof can be used. In particular, linear siloxanes can be used from the viewpoint of readiness in synthesis.

In the component (b), Si—H bonds may be present in any of the siloxane units in the molecule. At least part of the Si—H bonds can be present at the molecular terminal of the organopolysiloxane, such as in $R1_2HSiO_{1/2}$ unit.

Furthermore, the component (a) and the component (b) can be contained in an addition-curable silicone rubber composition such that the proportion of the number of unsaturated aliphatic groups to the number of silicon atoms is 0.001 or more and 0.020 or less, particularly preferably 0.002 or more and 0.010 or less. The component (a) and the component (b) can be contained in an addition-curable silicone rubber composition such that the proportion of the number of active hydrogen atoms to the number of the unsaturated aliphatic groups is 0.3 or more and 0.8 or less. At a proportion of the number of active hydrogen atoms to the number of the unsaturated aliphatic groups of 0.3 or more, a silicone rubber after curing can stably have desired hardness. At a proportion of the number of active hydrogen atoms to the number of the unsaturated aliphatic groups of 0.8 or less, an excess increase in hardness of the silicone rubber can be prevented. The proportion of the number of active hydrogen atoms to the number of the unsaturated aliphatic groups can be determined as follows: the number of unsaturated aliphatic groups and the number of active hydrogen atoms are quantified by hydrogen nuclear magnetic resonance analysis (1H-NMR (trade name: AL400 FT-NMR, manufactured by JEOL Ltd.)) to calculate the proportion.

Examples of the component (c) include known substances such as platinum compounds and rhodium compounds.

The composition may contain a reaction controller (inhibiter) besides the components (a) to (c). As the reaction controller, known substances such as methyl vinyl tetrasiloxane, acetylene alcohols, siloxane-modified acetylene alcohols and hydroperoxide can be used.

A highly thermal conductive filler (hereinafter, referred to as "filler") can be mixed with the silicone rubber forming the elastic layer 232 to enhance the thermal conductivity of the elastic layer 232. As the filler, SiC, ZnO, $Al_2O_3$, AlN, MgO and carbon can be used. These fillers can be used singly, or can be used in the form of a mixture. These fillers added to the elastic layer 232 can also give conductivity to the elastic layer 232.

It is desired that the elastic layer 232 has a thickness of 30 μm or more and 500 μm or less, preferably 100 μm or more and 300 μm or less. An elastic layer 232 having a thickness in this range can sufficiently demonstrate the elasticity, facilitating formation of high-quality images having high gloss and little fixing unevenness. Such an elastic layer can more effectively prevent a reduction in quick starting properties of the fixing apparatus 6, which is caused by an excessively increased heat capacity of the fixing member.

(Method of Forming Surface Layer)

The following methods (i) and (ii) are known as the method of forming the surface layer 233:

(i) a method of forming a coating of a fluorine resin dispersion on the surface of the elastic layer 232, the dispersion prepared by dispersing fluorine resin particles in an aqueous dispersion medium, and firing the coating to fuse at least part of the fluorine resin particles to form a surface layer including a fluorine resin film (hereinafter, also referred to as "coating method"), and (ii) a method of coating the surface of the elastic layer 232 with fluorine resin tubes prepared by extrusion molding a fused fluorine resin into a cylindrical shape, and fixing the tubes (hereinafter, also referred to as "tube coating method").

In the coating method, the state of the PTFE as polymerized is readily maintained through the formation process of the surface layer. For this reason, use of the coating method as the method of forming a surface layer is more preferred in this aspect. The fixing member including an elastic layer and a surface layer formed on the elastic layer by the coating method has a configuration in which the elastic layer is in direct contact with the surface layer.

The method of forming a surface layer by the coating method will now be described in detail.

(1) Step of Forming Coating

First, as a coating material for forming a surface layer, particles of PTFE and a different fluorine resin having a melting point lower than that of the PTFE are dispersed in an aqueous dispersion medium to prepare a fluorine resin dispersion. Then, the coating material for forming a surface layer is applied onto the surface of the elastic layer 232 to form a coating containing the fluorine resin (hereinafter, simply referred to as "coating").

Here, the coating material for forming a surface layer may contain a film forming agent, a surfactant and a viscosity control agent in addition to the fluorine resin.

The fluorine resins (PTFE and the different fluorine resin) contained in the coating material for forming a surface layer can be in the form of particles. The fluorine resin particles can have an average particle diameter (volume average particle diameter) of 0.1 μm or more and 5 μm or less. The volume average particle diameter of the fluorine resin particles is the volume average particle diameter determined by a light scattering method.

As the PTFE, PTFE as polymerized is used to attain a high degree of crystallization. It is important that the particles of PTFE as polymerized are prepared by a polymerization reaction, and are not subjected to a heat treatment at a temperature equal to or more than the melting point of the PTFE.

Before application of the coating material for forming a surface layer, the elastic layer 232 may be subjected to a surface treatment to enhance the adhesiveness between the elastic layer 232 and the surface layer 233. Examples of the surface treatment specifically include application of a silane coupling agent, irradiation with ultraviolet light (UV), a plasma treatment and a flame treatment. A plurality of surface treatments may be used in combination, for example, application of a silane coupling agent after irradiation with ultraviolet light.

(2) Step of Heating Coating to Form Surface Layer

Subsequently, the coating on the elastic layer 232 is melted by heating to form the surface layer 233.

The melting point of the PTFE as polymerized is 330° C. or more and 340° C. or less while the melting point of the different fluorine resin such as standard PFA and FEP is 315° C. or less. The heating temperature of the coating is controlled to a temperature of 315° C. or more and less than the melting point of the PTFE. The different fluorine resin can be thereby melted without fusing the PTFE as polymerized to form the surface layer 233. The heating temperature of the coating is more preferably 315° C. or more and less than 330° C.

The heating time for the coating is desirably 1 minute or more and 30 minutes or less to prevent thermal degradation of the elastic layer 232. The heating time is suitably 15 minutes or less.

Examples of heating apparatuses include, but should not be limited to, ovens, muffle furnaces, infrared lamp heaters and tubular furnaces.

(Configuration of Entire Image Forming Apparatus)

FIG. 1 is a schematic configurational view of one example of an image forming apparatus including the fixing apparatus according to one aspect of the present invention. This image forming apparatus is an electrophotographic laser beam printer (hereinafter, referred to as printer).

The printer illustrated in FIG. 1 includes an electrophotographic photosensitive member (hereinafter, referred to as photosensitive drum) 18 in the form of a rotary drum as an image bearing member.

The photosensitive drum 18 rotates in the arrow direction at a predetermined circumferential speed (process speed) in response to a print instruction. While the photosensitive drum 18 is rotating, the outer peripheral surface (surface) of the photosensitive drum 18 is uniformly charged to a predetermined polarity and potential by a charging roller 17 as a charging unit. The uniformly charged surface of the photosensitive drum 18 is exposed through scanning with a laser beam LB output from a laser beam scanner 3 and modulated (ON/OFF controlled) according to the image information. An electrostatic latent image is thereby formed on the surface of the photosensitive drum 18 according to the intended image information. This latent image is developed into a toner image with a toner TO by a developing apparatus 4 as a developing unit to be visualized.

Recording materials P accumulated and stored in a sheet feed cassette 9 are fed one by one as a result of driving of a sheet feed roller 8, and are sent through a sheet path having a guide 10 to a registration roller 11. The recording material P is fed to a transfer nip between the surface of the photosensitive drum 18 and the outer peripheral surface (surface) of a transfer roller 5 by the registration roller 11 at a predetermined control timing. The recording material P is held by the transfer nip, and is conveyed. While the recording material P is being conveyed, the toner image on the surface of the photosensitive drum 18 is sequentially transferred onto the surface of the recording material P according to the transfer bias applied to the transfer roller 5. As a result, a non-fixed toner image is carried on the recording material P.

The recording material P carrying the non-fixed toner image (non-fixed image) is sequentially separated from the surface of the photosensitive drum 18, is discharged from the transfer nip, and is introduced through a conveying guide 12 into the nip of the fixing apparatus 6 as the fixing unit. Heat and pressure are applied to the recording material P in the nip of the fixing apparatus 6, thereby thermally fixing the toner image on the surface of the recording material P. The recording material P leaving the fixing apparatus 6 passes through a sheet path having a conveying roller 13, a guide 14 and a discharge roller 15, and is discharged onto a discharge tray 16. After the recording material is separated, the surface of the photosensitive drum 18 is cleaned by a cleaning apparatus 7 as a cleaning unit through removal of adhering contaminants such as transfer residual toners, and is repeatedly used for image formation.

(Configuration of Fixing Apparatus)

In the fixing apparatus and the members included in the fixing apparatus described below, the longitudinal direction indicates a direction perpendicular to the recording material conveying direction on the surface of the recording material. The short direction indicates a direction parallel to the recording material conveying direction on the surface of the recording material. The width indicates the dimension in the short direction.

Figure 2:
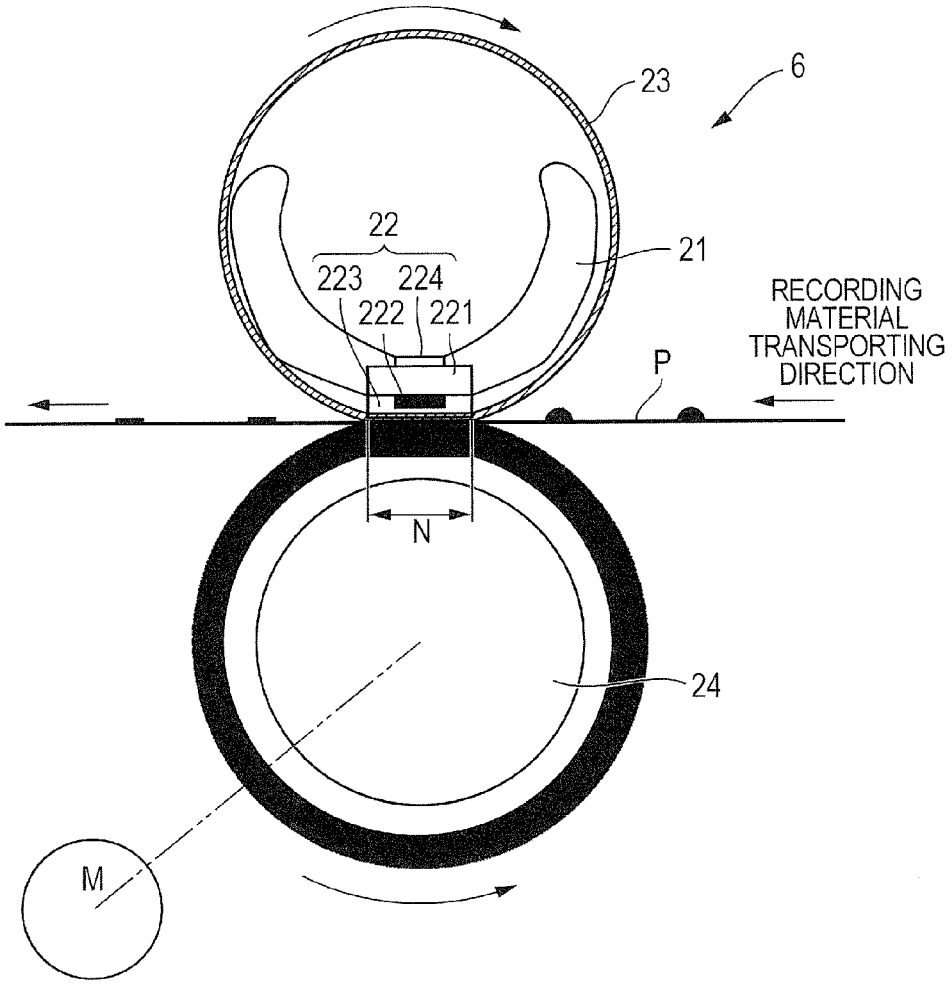
FIG. 2 is a schematic configurational view of the cross-sectional side surface of one example of the fixing apparatus according to one aspect of the present invention.

FIG. 2 is a schematic configurational view of the cross-sectional side surface of the fixing apparatus 6 including the fixing member according to one aspect of the present invention. This fixing apparatus 6 is a fixing apparatus of a film heating type.

A film guide 21 is in the form of a cullis having an approximately semi-circular cross section. The film guide is an elongate member extending in the longitudinal direction in the direction vertical to the drawing. A heater is accommodated and supported in a groove formed approximately in the center of the bottom surface of the film guide 21 along the longitudinal direction.

The fixing belt 23 is the fixing member according to one aspect of the present invention, and is in the form of an endless belt (cylindrical). The fixing belt 23 is loosely wound around the guide 21 supporting the heater 22. The guide 21 is a molded article of a heat resistant resin such as polyphenylene sulfite (PPS) or a liquid crystal polymer, for example.

The heater 22 includes a heater substrate 221 made of an alumina thin plate. On the surface (surface on the side N of the nip described later) of the heater substrate 221, a linear or ribbon-like Ag/Pd heating body 222 generating heat through electrical conduction is formed along the longitudinal direction of the heater substrate 221. The heating body 222 is coated with a surface protective layer 223 containing a glass material for protection, for example. A thermistor 224 as a temperature detecting member is disposed on the rear surface (surface opposite to the surface on the side N of the nip) of the heater substrate 221.

A pressurizing roller 24 is a pressurizing member in the form of a roller. The pressurizing roller 24 is disposed under the fixing belt 23 facing the fixing belt 23. The pressurizing roller 24 is pressed against the heater 22 by a pressurizing mechanism not illustrated with the fixing belt 23 interposed therebetween. The outer peripheral surface (surface) of the pressurizing roller 24 is brought into contact with the outer peripheral surface (surface) of the fixing belt 23 to elastically deform the pressurizing roller 24. As a result, a nip N (fixing nip) having a predetermined width is formed between the surface of the pressurizing roller 24 and the surface of the fixing belt 23.

<Thermal Fixing Operation of Fixing Apparatus>

A fixing motor M as a driving source rotates in response to a print instruction. The rotating force of the fixing motor M is transmitted to the pressurizing roller 24 through a power transmission mechanism (not illustrated). As a result, the pressurizing roller 24 rotates in the arrow direction at a predetermined circumferential speed (process speed). The rotation of the pressurizing roller 24 is transmitted to the surface of the fixing belt 23 through the nip N. The fixing belt 23 rotates in the arrow direction following the rotation of the pressurizing roller 24.

One aspect of the present invention can provide a fixing member having high resistance to wear and a method of producing the fixing member. Another aspect of the present invention can provide a fixing apparatus and an image forming apparatus which can stably provide high-quality electrophotographic images.

EXAMPLES

Example 1

As a substrate for the fixing belt, a stainless steel substrate in the form of an endless belt having an outer diameter of 30 mm, a thickness of 40 μm, and a length of 400 mm in the axis direction was prepared.

A liquid silicone rubber mixture containing an addition-curable silicone rubber (trade name: XE15-B9236, manufactured by Momentive Performance Materials Japan LLC) was applied onto the outer peripheral surface of the substrate to form a coating of the liquid silicone rubber mixture. The coating had a thickness of 300 μm. The coating was then heated to 200° C. to react the addition-curable silicone rubber in the coating. An elastic layer containing a silicone rubber was thereby formed.

Next, the surface of the elastic layer was UV treated. Although the UV treatment is not essential, the UV treatment can reduce the tackiness of the surface of the silicone rubber elastic layer and give hydrophilicity to the surface of the silicone rubber elastic layer.

Next, a silane coupling agent 3-aminopropyltriethoxysilane (trade name: KBE-903, manufactured by Shin-Etsu Chemical Co., Ltd.) was diluted with ethanol 5-fold in terms of the weight ratio, and this diluted solution was applied onto the surface of the elastic layer by spray coating. The coating was spontaneously dried at room temperature. The coating of the silane coupling agent after drying had a thickness of 1.0 μm. Subsequently, a primer (trade name: EK-1909521L, manufactured by DAIKIN INDUSTRIES, LTD.) was uniformly applied by spray coating onto the surface of the coating of the silane coupling agent so as to have a dry thickness of 2 μm.

Next, 50 parts by mass of PFA (trade name: Teflon (registered trademark) PFA 350-J, manufactured by Du Pont-Mitsui Fluorochemicals Company, Ltd., volume average particle diameter: 0.1 μm) and 50 parts by mass of fine powder of PTFE as polymerized (trade name: KTL-500F, manufactured by KITAMURA LIMITED, volume average particle diameter: 0.3 μm) were dispersed in water such that the fluorine resin solid content was 40% by mass. A coating material for forming a surface layer was thereby prepared.

The coating material for forming a surface layer was applied onto the surface of the primer layer by spray coating such that the thickness after firing was 15 μm. While the temperature of the coating was kept at 315° C. for 15 minutes, the PFA particles in the coating were then melted, and the fine powder of the PTFE as polymerized in the coating was not melted. Subsequently, the resulting belt was cooled by blowing cool air having a temperature of 25° C. Thus, an endless fixing belt including the stainless steel substrate, and the elastic layer containing a silicone rubber and the fluorine resin layer disposed on the outer peripheral surface of the substrate was prepared.

Example 2

A fixing belt was prepared in the same manner as in Example 1 except that the heating temperature of the coating was 320° C.

Example 3

A fixing belt was prepared in the same manner as in Example 1 except that the heating temperature of the coating was 325° C.

Example 4

A coating material for forming a surface layer was prepared in the same manner as in Example 1 except that the mass ratio of PFA to PTFE (PFA:PTFE) in the coating material for forming a surface layer was 6:4. The coating material for forming a surface layer was used, and the heating temperature of the coating of the coating material for forming a surface layer was 325° C. Except for these, a fixing belt was prepared in the same manner as in Example 1.

Comparative Example 1

A fixing belt was prepared in the same manner as in Example 1 except that the heating temperature of the coating was 310° C.

Comparative Example 2

A fixing belt was prepared in the same manner as in Example 1 except that the heating temperature of the coating was 350° C.

Comparative Example 3

A coating material for forming a surface layer was prepared in the same manner as in Example 1 except that the mass ratio of PFA to PTFE (PFA:PTFE) in the coating material for forming a surface layer was 4:6. The coating material for forming a surface layer was used, and the heating temperature of the coating of the coating material for forming a surface layer was 325° C. Except for these, a fixing belt was prepared in the same manner as in Example 1.

Comparative Example 4

A fixing belt was prepared in the same manner as in Comparative Example 3 except that the heating temperature of the coating was 350° C.

The fixing belts prepared in Examples 1 to 4 and Comparative Examples 1 to 4 were evaluated as follows.

Figure 4:
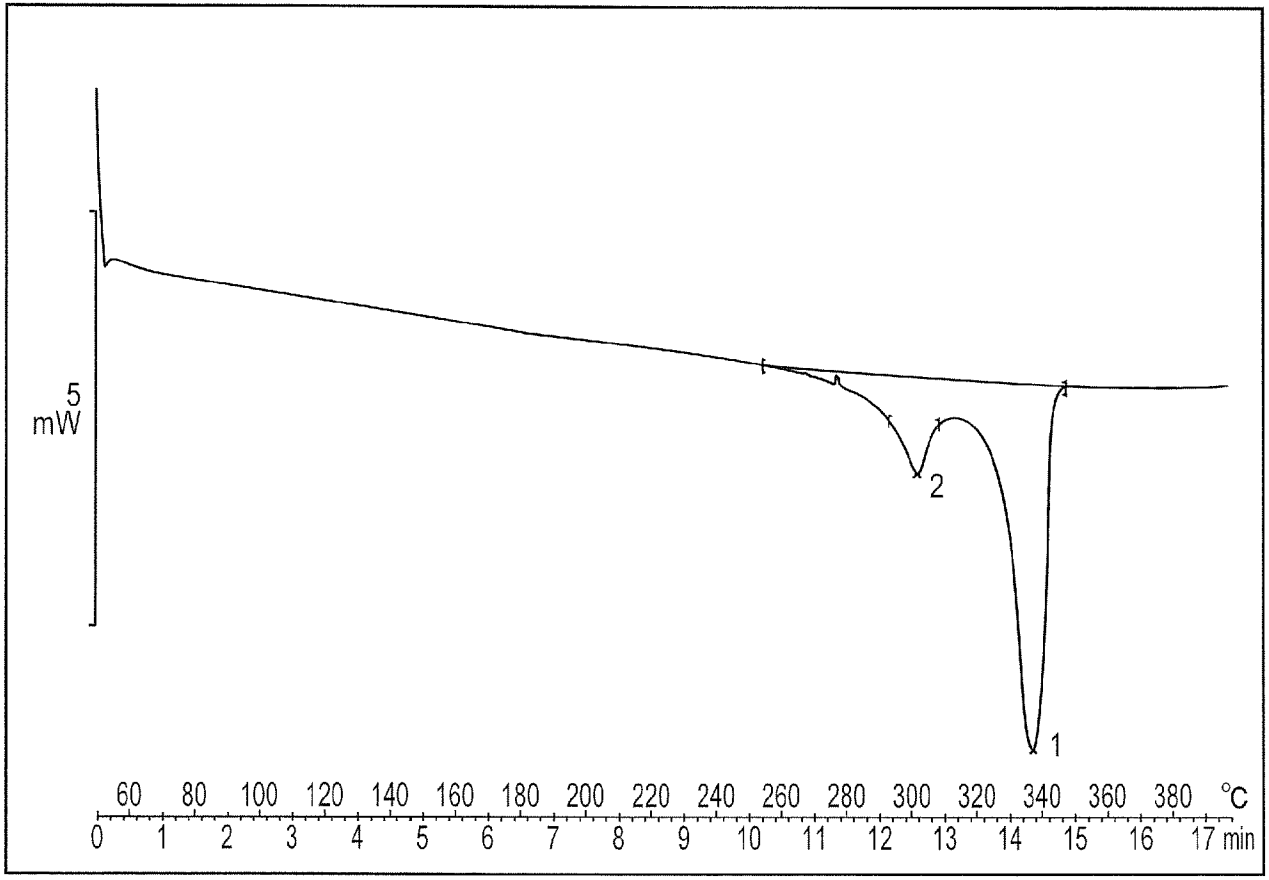
FIG. 4 is a DSC curve of the surface layer according to Example 4.

(1) Measurement of Amount of Heat of Fusion and Melting Point of Fixing Belt Surface Layer In each of the fixing belts, 5 mg of a sample was extracted from the surface layer. Each sample was heated with a differential scanning calorimeter (DSC) (manufactured by Mettler-Toledo International Inc., "DSC823e," software: "STARe Software") at a temperature raising rate of 20° C./min according to the method described above to measure the amount of heat of fusion ΔH (J/g) and the melting point. The melting point at an endothermic peak 1 (high temperature) and that at an endothermic peak 2 (low temperature) were determined. A DSC curve of the sample from the surface layer according to Example 4 is illustrated in FIG. 4.

(2) Durability Test for Fixing Belt

The fixing belts were subjected to a durability test described below to evaluate the resistance to wear of the surface layer. First, each of the fixing belts was mounted on a fixing apparatus having the configuration illustrated in FIG. 2. The fixing apparatus was incorporated in a laser beam printer enabling high-speed fixing at 60 sheets/min (process speed: 350 mm/sec), and 300,000 sheets of paper of size A4 were continuously fed in a continuous sheet feeding mode. The surface temperature of the fixing belt during fixing was set at 200° C. Sheets were fed under an environment at a temperature of 15° C. and a humidity of 20%. After continuous feed of those sheets, the fixing belt was detached. The surface of the fixing belt was visually observed to evaluate the surface according to the following criteria:

Rank "A": no peel-off of the surface layer is found.

Rank "B": peel-off of the surface layer is found in portions with which the edges of the paper are brought into contact (collision flaw called kamikoba).

(3) Evaluation of Off-Setting of Fixing Belt

Each of the fixing belts was mounted on a fixing apparatus having the configuration illustrated in FIG. 2. The fixing apparatus was incorporated in a laser beam printer enabling high-speed fixing at 60 sheets/min (process speed: 350 mm/sec). Rough paper (Fox River Bond, manufactured by Fox River Paper Company) of a letter size having a basis weight of 75 g/cm$^2$ was used as a recording material. An image having a black and halftone (gray) pattern of a 5 mm square at 9 places per sheet was continuously output on 250 sheets. The surface temperature of the fixing belt during output of the image was set at 200° C. The image was output under an environment at a temperature of 15° C. and a relative humidity of 20%.

The image on the 250th sheet was observed whether image defects caused by off-setting were found.

Rank "A": image defects caused by off-setting are not found.

Rank "B": image defects caused by off-setting are found.

The results of Examples and Comparative Examples are shown in Table 1.

TABLE 1

| | | PFA [% by mass] | PTFE [% by mass] | Heating temperature [° C.] | ΔH [J/g] | Peak top temperature at endothermic peak 1 [° C.] | Peak top temperature at endothermic peak 2 [° C.] | Rank of evaluation of resistance to wear | Rank of evaluation of off-setting |
|---|---|---|---|---|---|---|---|---|---|
| Example | 1 | 50 | 50 | 315 | 53 | 337 | 300 | A | A |
| | 2 | 50 | 50 | 320 | 50 | 337 | 300 | A | A |
| | 3 | 50 | 50 | 325 | 48 | 337 | 301 | A | A |
| | 4 | 60 | 40 | 325 | 44 | 337 | 301 | A | A |
| Comparative Example | 1 | 50 | 50 | 310 | 56 | 336 | 315 | — | — |
| | 2 | 50 | 50 | 350 | 32 | 311 | | B | A |
| | 3 | 40 | 60 | 325 | 58 | 337 | 301 | A | B |
| | 4 | 40 | 60 | 350 | 40 | 313 | | A | B |

In the results of Table 1, a peak top (melting point) is present in the temperature range of 330° C. or more and 340° C. or less and a sum ΔH of 40 J/g or more results in a high degree of crystallization in the surface layers of the fixing belts according to Examples 1 to 4. It is considered that the state of the PTFE as polymerized is kept because the heating temperature of the coating is 315° C. or more and 330° C. or less.

In contrast, in Comparative Example 1, PFA was not melted because the heating temperature was as low as 310° C., and the fluorine resin was not formed into a film.

In Comparative Example 1, the peak top temperature at the endothermic peak 2 is 315° C., and is higher than that (temperature: 300° C. or 301° C.) in Examples 1 to 4. The reason is considered to be because the surface layers according to Examples 1 to 4 contain PFA after melting while the surface layer according to Comparative Example 1 contains unmelted PFA.

In Comparative Example 2, the sum ΔH was 32 J/g, and the surface layer had a low degree of crystallization. For this reason, the resistance to wear is ranked "B." In Comparative Example 2, it is considered that not only the PFA but also the PTFE as polymerized in the coating are melted because the heating temperature of the coating of the coating material for forming a surface layer is as high as 350° C. For this reason, it is considered that the surface layer according to Comparative Example 2 lost a high degree of crystallization unique to the PTFE as polymerized, resulting in a surface layer having a low degree of crystallization.

Only one endothermic peak was observed in the DSC curve obtained from the sample of the surface layer according to Comparative Example 2. The reason is considered to be because the coating of the coating material for forming a surface layer was fired at a high temperature of 350° C. in Comparative Example 2; as a result, both of the PTFE as polymerized and the PFA are melted, and the PTFE and the PFA are miscible in the surface layer.

In Comparative Example 3, the PTFE in the surface layer keeps the state as polymerized, resulting in a high degree of crystallization of the fluorine resin in the surface layer. However, a large proportion of the PTFE as polymerized in the fluorine resin reduces the toner releasing properties of the surface layer, depending on the PFA. As a result, off-setting is ranked "B."

In Comparative Example 4, the heating temperature of the coating of the coating material for forming a surface layer was as high as 350° C. The PTFE in the surface layer cannot keep the high crystalline state unique to the PTFE as polymerized. In addition, a large amount of PTFE was contained such that the sum ΔH was 40 J/g or more; the proportion of the PFA in the fluorine resin contained in the surface layer was relatively reduced. As a result, the toner releasing properties of the surface of the surface layer was reduced, and off-setting is ranked "B."

Only one endothermic peak was observed in the DSC curve obtained from the sample of the surface layer according to Comparative Example 4 probably for the same reason as that in Comparative Example 2.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-198868, filed Oct. 6, 2015, which is hereby incorporated by reference herein in its entirety.

What is claimed is:

1. A fixing member comprising:

a surface layer containing polytetrafluoroethylene (PTFE) and a fluorine resin having a melting point lower than that of the PTFE, wherein, in a DSC (endothermic) curve obtained by heating a sample of the surface layer at a temperature raising rate of 20° C./min with a differential scanning calorimeter (DSC), an endothermic peak 1 having a peak top in a temperature range of 330° C. to 340° C. and an endothermic peak 2 having a peak top in a temperature range lower than that of the endothermic peak 1 are present, and wherein a sum ΔH of an amount of heat of fusion based on the endothermic peak 1 and an amount of heat of fusion based on the endothermic peak 2 is 40 J/g to 55 J/g.

2. The fixing member according to claim 1, wherein the endothermic peak 1 is derived from the PTFE.

3. The fixing member according to claim 1, wherein the sum ΔH is 43 J/g to 55 J/g.

4. The fixing member according to claim 1, wherein the fluorine resin is a tetrafluoroethylene-perfluoroalkyl vinyl ether copolymer (PFA).

5. The fixing member according to claim 4, wherein a peak top temperature of the endothermic peak 2 is 300° C. to 315° C.

6. The fixing member according to claim 1, wherein the fixing member comprises a substrate, an elastic layer and the surface layer in this order.

7. The fixing member according to claim 6, wherein the substrate is in a form of an endless belt, and wherein the elastic layer and the surface layer are disposed on an outer peripheral surface of the substrate in this order.

8. The fixing member according to claim 7, wherein the surface layer is in direct contact with the elastic layer.

9. A fixing apparatus comprising:

a fixing member; and a pressurizing member disposed facing the fixing member, wherein the fixing member is a fixing member comprising a surface layer containing polytetrafluoroethylene (PTFE) and a fluorine resin having a melting point lower than that of the PTFE, wherein, in a DSC (endothermic) curve obtained by heating a sample of the surface layer at a temperature raising rate of 20° C./min with a differential scanning calorimeter (DSC), an endothermic peak 1 having a peak top in a temperature range of 330° C. to 340° C. and an endothermic peak 2 having a peak top in a temperature range lower than that of the endothermic peak 1 are present, and wherein a sum ΔH of an amount of heat of fusion based on the endothermic peak 1 and an amount of heat of fusion based on the endothermic peak 2 is 40 J/g to 55 J/g.

10. An image forming apparatus comprising a fixing unit for fixing a non-fixed toner image on a recording material, wherein the fixing unit includes:

a fixing apparatus comprising a fixing member and a pressurizing member disposed facing the fixing member, wherein the fixing member is a fixing member comprising a surface layer containing polytetrafluoroethylene (PTFE) and a fluorine resin having a melting point lower than that of the PTFE, wherein, in a DSC (endothermic) curve obtained by heating a sample of the surface layer at a temperature raising rate of 20° C./min with a differential scanning calorimeter (DSC), an endothermic peak 1 having a peak top in a temperature range of 330° C. to 340° C. and an endothermic peak 2 having a peak top in a temperature range lower than that of the endothermic peak 1 are present, and wherein a sum ΔH of an amount of heat of fusion based on the endothermic peak 1 and an amount of heat of fusion based on the endothermic peak 2 is 40 J/g to 55 J/g.

11. A method of producing a fixing member comprising an elastic layer, and a surface layer containing polytetrafluoroethylene (PTFE) and a fluorine resin having a melting point lower than that of the PTFE, the method comprising:

forming a coating of a coating material for forming the surface layer on the elastic layer, the coating material containing PTFE having a melting point of 330° C. to 340° C. and a fluorine resin having a melting point lower than that of the PTFE at a mixing ratio of 40:60 to 60:40 (mass ratio); and heating the coating at a temperature of 315° C. to less than the melting point of the PTFE to form the surface layer.

12. The method according to claim 11, wherein the temperature in the heating of the coating is 315° C. to less than 330° C.

13. The method according to claim 11, wherein the fluorine resin is a tetrafluoroethylene-perfluoroalkyl vinyl ether copolymer (PFA).

* * * * *